US006634148B2

(12) United States Patent
Shidler

(10) Patent No.: US 6,634,148 B2
(45) Date of Patent: Oct. 21, 2003

(54) INSULATED POURED WALL SYSTEM

(76) Inventor: Edward C. Shidler, 6121 1369th Ave., Saugatuck, MI (US) 49453

( * ) Notice: Subject to any disclaimer, the term of this patent is extended or adjusted under 35 U.S.C. 154(b) by 35 days.

(21) Appl. No.: 09/997,680

(22) Filed: Nov. 29, 2001

(65) Prior Publication Data

US 2003/0097807 A1 May 29, 2003

(51) Int. Cl.[7] ..... E04B 1/00

(52) U.S. Cl. ..... 52/270; 52/309.11; 52/481.1; 52/787.1; 249/191; 249/216

(58) Field of Search ..... 52/270, 783.1, 52/787.1, 794.1, 309.11, 481.1; 249/33, 40, 44, 47, 216, 191

(56) References Cited

U.S. PATENT DOCUMENTS

| | | | | |
|---|---|---|---|---|
| 1,535,220 | A | 4/1925 | Gallagher | |
| 3,362,678 | A | 1/1968 | Bowden | |
| 3,438,161 | A | 4/1969 | Koch | |
| 4,669,234 | A | 6/1987 | Wilnau | |
| 5,060,441 | A | 10/1991 | Pichette | |
| 5,953,883 | A | 9/1999 | Ojala | |
| 6,079,176 | A | 6/2000 | Westra et al. | |
| 6,178,711 | B1 * | 1/2001 | Laird et al. | 52/427 |
| 2001/0000844 | A1 * | 5/2001 | Kubica | 52/427 |

* cited by examiner

*Primary Examiner*—Carl D. Friedman
*Assistant Examiner*—Naoko Slack
(74) *Attorney, Agent, or Firm*—Price, Heneveld, Cooper, DeWitt & Litton

(57) ABSTRACT

An improved method of forming an insulated poured concrete wall, a system for forming an insulated poured concrete wall, and an insulated poured concrete wall are provided. The system includes spaced-apart wall forms defining a cavity, a plurality of insulating panels adjacent at least one of the opposing wall surfaces, and a plurality of the elongate retaining strips between adjacent insulating panels, wherein each of the elongate retaining strips includes a portion that projects into the cavity and/or each of the elongate retaining strips has at least one notch through which a wall tie passes. The system allows building materials such as drywall, siding, paneling, and the like, as well as heavier objects, such as cabinets to be more stably and durably secured to an insulated poured concrete wall, and facilitates construction of an insulated concrete wall using fewer components and less labor.

39 Claims, 4 Drawing Sheets

INSULATED POURED WALL SYSTEM

FIELD OF THE INVENTION

This invention relates to insulated concrete wall systems, and more particularly to poured concrete wall systems in which a thermal insulation panel is joined to the concrete wall by an elongate retaining strip having edges engaging grooves formed in opposing vertical edges of the insulating panels.

BACKGROUND OF THE INVENTION

Poured concrete walls are formed by pouring or pumping uncured concrete between rigid planar forms generally made of wood, aluminum, steel or a combination of these materials. Two series of coplanar forms are typically held in spaced-apart, parallel relationship by retaining ties to create a cavity in which the poured concrete wall is formed.

Poured concrete walls can be constructed more quickly and at a lower cost than comparable alternative wall structures, while providing excellent durability, structural integrity, and other aesthetic and functional characteristics. However, poured concrete walls have relatively poor thermal insulating properties, and methods for incorporating insulative material in a poured concrete wall often have been difficult, requiring excessive time, labor and cost. Some of these methods require unconventional wall forms which are more costly to obtain and use than conventional wall forms.

U.S. Patent Application Publication No. U.S. 2001/0000844 A1 (incorporated in its entirety herein) describes an insulated concrete wall structure having embedded wall ties and a series of elongate retaining strips positioned between vertically spaced wall ties. Insulating panels are located between the horizontally spaced wall ties and are retained in position by the retaining strips. An advantage of this system is that an insulated poured concrete wall can be constructed using conventional wall forms in approximately the same amount of time as conventional uninsulated poured concrete walls. The resulting insulated poured wall system can be constructed at a lower cost than other known insulated poured concrete wall systems. Additionally, it is disclosed that the retaining strips allow building material such as drywall or paneling to be attached to the face of the insulating panels once the wall forms are removed and the wall is completed. However, this wall system is deficient in certain respects. First, the elongate retaining strips are not secured directly to the concrete wall, but instead are secured at opposite ends of the retaining strip to wall ties by notches formed in the wall ties. As a result, the elongate retainers are retained along their vertical edges between adjacent insulation panels and at their upper and lower edges between the notches in the vertically spaced-apart ties. This can allow some freedom of movement of the elongate retaining strips when building materials, especially heavy objects such as cabinets, are attached to the elongate retainers. In extreme cases, this can cause structures supported on the elongate retainers to pull away from the wall. Accordingly, there is a need for a more rigid insulation panel retainer that is capable of securely supporting heavier loads.

Another problem with the insulated concrete wall system disclosed by Patent Publication No. U.S. 2001/0000844 A1 is that it requires a plurality of elongate retaining strips between adjacent insulation panels. More specifically, one retaining strip is located between each set of vertically spaced-apart ties. The publication states that the height or length of the retaining strips is dependent upon the distance between adjacent ties, but is typically about one foot in length. Thus, for a typical poured concrete basement wall, eight retaining strips aligned vertically between adjacent insulation panels are needed. To reduce construction costs, it would be desirable to reduce the number of retainers that are required. Because the retainers are vertically spaced-apart, there are areas along the seam between adjacent insulation panels, in the vicinity of the ties, that are unavailable for engagement with a fastener to allow building materials to be attached. As a result, care must be taken to avoid locating fasteners in the area between vertically spaced-apart retaining strips when securing building materials such as drywall or paneling to the insulation panels.

Another disadvantage with the insulated concrete wall system described in United States Patent Application Publication U.S. 2001/0000844 A1 is that the flat surface of the elongate retaining strips can make it difficult to insert fasteners through the retaining strip. In particular, it can be difficult to initiate penetration of a drywall screw through the flat surface of the retaining strips.

SUMMARY OF THE INVENTION

The present invention provides an improved method of forming an insulated poured concrete wall, a system for forming an insulated poured concrete wall, and an insulated poured concrete wall. The invention allows insulated concrete walls to be formed more efficiently and at a lower cost by using fewer components. The invention also allows building materials such as drywall, siding, paneling, and the like, as well as heavier objects, such as cabinets, to be more stably and durably secured to the wall.

In accordance with one aspect of the invention, there is provided a system for forming an insulated poured concrete wall. The system includes spaced-apart wall forms forming opposing wall surfaces that define a cavity, a plurality of insulating panels arranged adjacent at least one of the opposing wall surfaces, and a plurality of elongate retaining strips between adjacent insulating panels, wherein each of the elongate retaining strips includes a portion that projects into the cavity.

In accordance with another aspect of this invention, a method of forming an insulated concrete wall is provided. The method includes arranging a plurality of wall forms in spaced relationship to form opposing wall surfaces defining a cavity, arranging insulating panels adjacent at least one of the opposing wall surfaces, arranging elongate retaining strips between adjacent insulating panels, wherein the elongate retaining strips engage edges of the insulating panels, and wherein a portion of each retaining strip projects into the cavity.

In accordance with another aspect of the invention, there is provided an insulated poured concrete wall comprising a concrete wall having opposing wall surfaces, a plurality of spaced-apart, elongate retaining strips, the elongate retaining strips having a portion embedded in the concrete wall with the length direction of the retaining strips extending vertically. A plurality of insulating panels is provided, with each panel being held between laterally spaced-apart retaining strips.

In accordance with another aspect of the invention, a system for forming an insulated poured concrete wall includes spaced-apart wall forms forming opposing wall surfaces that define a cavity, a plurality of vertically and horizontally spaced-apart wall ties extending between the opposing wall forms, a plurality of insulating panels arranged adjacent at least one of the opposing wall surfaces, and a plurality of elongate retaining strips between adjacent insulating panels, with each elongated retaining strip having at least one notch through which a wall tie passes.

In accordance with another aspect of the invention, there is provided a method of forming an insulated poured concrete wall using a plurality of elongate retaining strips, wherein each elongate retraining strip includes at least one notch that allows a wall tie to pass through.

Another aspect of the invention provides an insulated poured concrete wall comprising a concrete wall having opposing wall surfaces, a plurality of vertically and horizontally spaced wall ties contained within the concrete wall and extending between the opposing wall surfaces, a plurality of insulating panels arranged adjacent at least one of the opposing wall surfaces, and a plurality of elongate retaining strips between adjacent insulating panels, each elongate retaining strip having at least one notch through which a wall tie passes.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
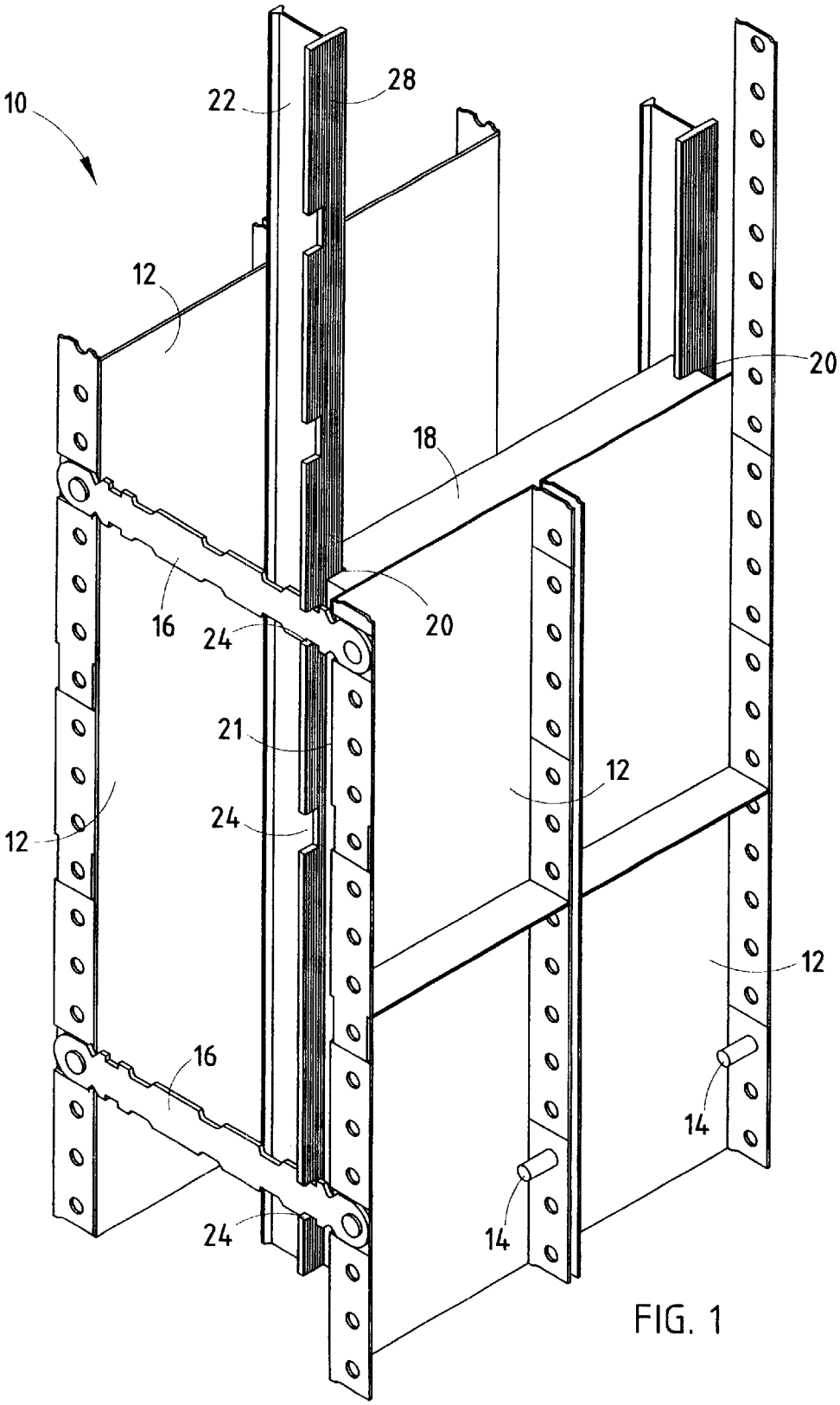
FIG. 1 is a perspective view of an insulated concrete wall system in accordance with the invention.

In FIG. 1, there is shown a perspective view of a portion of a poured wall forming system 10 embodying the present invention. The system includes a plurality of wall forms 12 which are arranged to form two series of coplanar wall forms held in opposing spaced-apart, parallel relationship. Adjacent wall forms 12 are held in a coplanar relationship by connecting pins 14, and the two series of coplanar wall forms are held in opposing spaced-apart parallel relationship by wall ties 16. Wall forms 12 may be constructed of wood, aluminum, iron, steel, or various other materials or combinations thereof.

Figure 2:
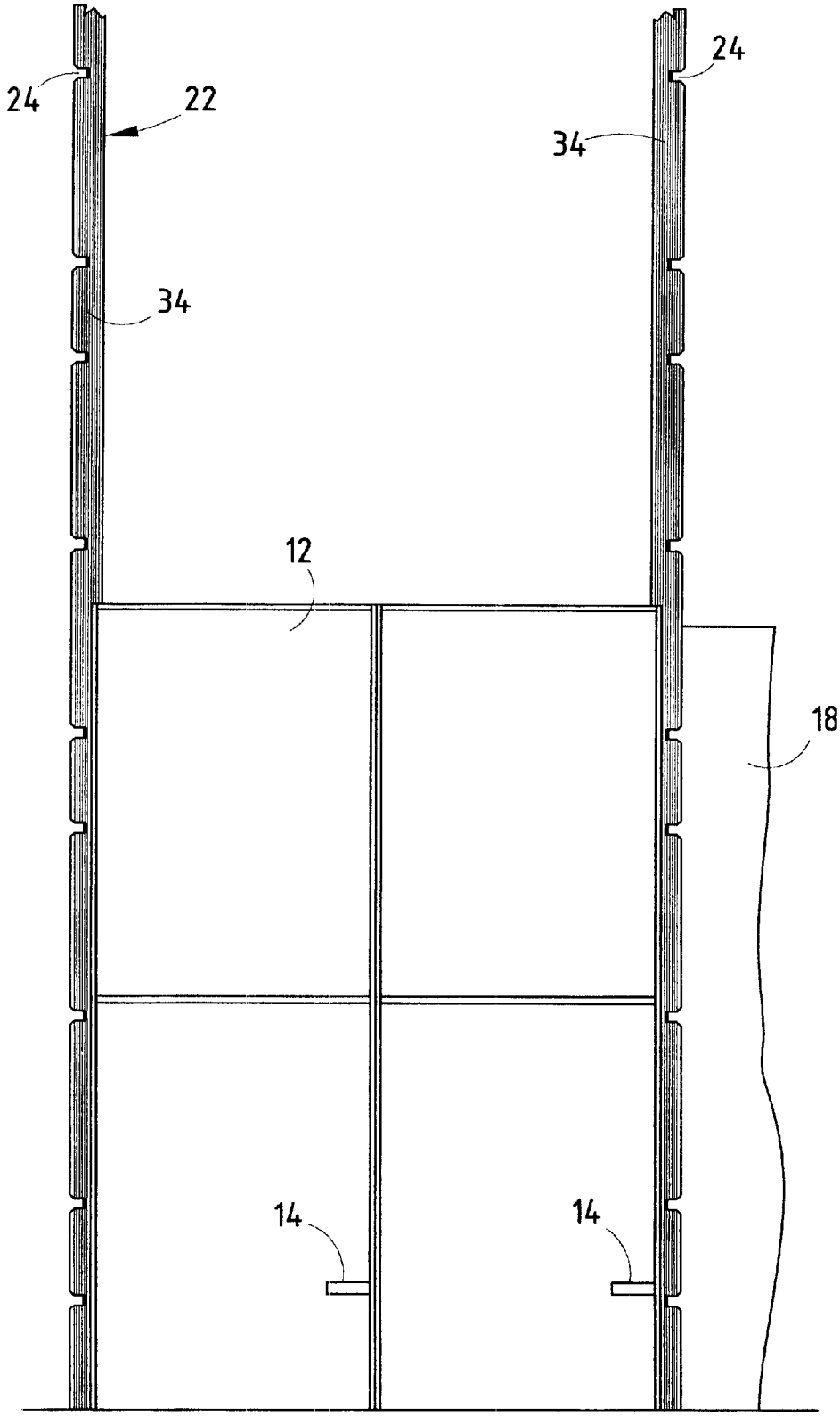
FIG. 2 is an elevational view of the wall system shown in FIG. 1.

The forms 12 are typically from about 2 to 6 feet wide and from about 2 to about 10 feet high. Connecting pins 14 are well known in the art. Insulating panels 18 are positioned adjacent the interior surfaces of at least ones of the series of wall forms 12. Grooves 20 are formed in opposing vertical edges of insulating panel 18. A long edge 28 of a T-shaped retaining strip 22 is received in groove 20. Insulating panels 18 are held in place at their edges between laterally spaced-apart retaining strips 22. As shown in FIG. 2, rather than extending between vertically spaced-apart ties 16, retainer 22 may extend the full height of the poured wall, e.g., such as 8 or 9 feet. This is achieved by providing a series of vertically spaced-apart notches 24 through which ties 16 pass. Thus, rather than extending between ties 16, retaining strip 22 extends uninterrupted past wall ties 16. Retaining strips 22 are temporarily held in place by engagement of notches 24 with notches in the edges of wall ties 16 until the concrete has been poured and cured. This reduces the number of retaining strips 22 which are needed, thus simplifying installation and reducing construction costs. While it is preferred that a single retaining strip 22 extend from floor to ceiling, i.e., the full height of a poured concrete wall, the benefits of the invention can be achieved using a plurality (e.g., two or three) of retaining strips 22 which together extend the full height of the poured concrete wall. In other words, notches 24 which allow ties 16 to pass through the retaining strip 22 facilitate a reduction in the number of retaining strips needed and thereby simplify and reduce the costs associated with installation of the insulated poured wall system.

In addition to reducing the number of retaining strips needed, the retaining strips 22 provide a continuous strip or stud that allows building materials such as drywall or paneling to be attached with fasteners such as screws or nails at any elevation, including an elevation at which a wall tie 16 is present.

Figure 3:
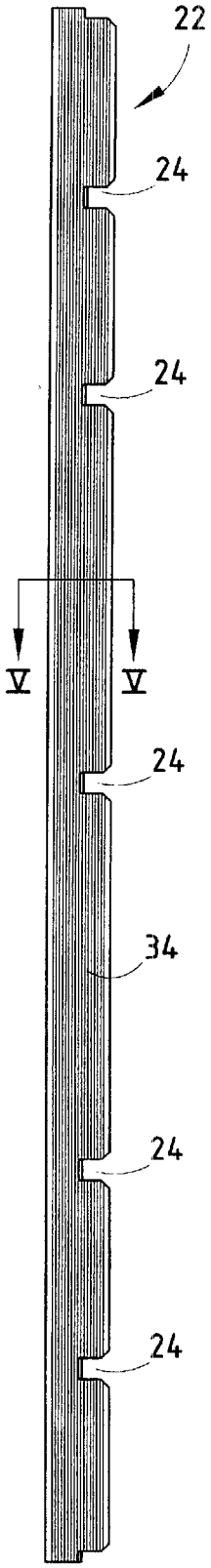
FIG. 3 is a front view of a retaining strip used in the wall system of this invention.
Figure 4:
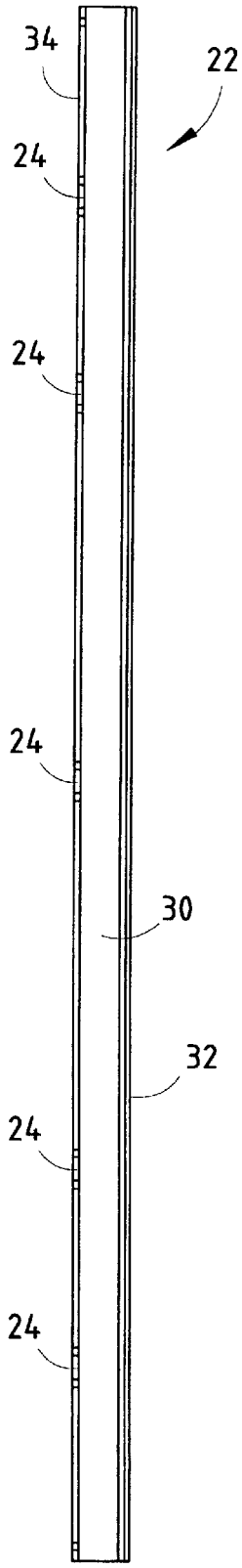
FIG. 4 is a side view of the retaining strip shown in FIG. 3.
Figure 5:
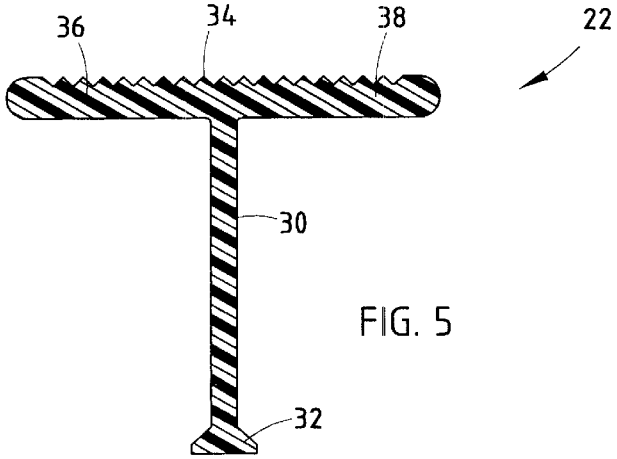
FIG. 5 is a cross-sectional of the retaining strip shown in FIGS. 3 and 4.

A preferred embodiment of a retaining strip 22 in accordance with the invention is shown in further detail in FIGS. 3–5. As shown in FIG. 5, retaining strip 22 has a T-shaped cross-sectional profile, including a web portion 30, an enlarged (e.g., flared or bulbous) anchor portion 32 at one end of web 30, and a flange portion 34 at the other end of web 30. Flange portion 34 is at a right angle with respect to web portion 30 and includes a left (with respect to the drawing shown in FIG. 5) side 36 and a right side 38. The left side (or half) of flange 34 constitutes a continuous, uninterrupted, rectangular strip, whereas the right side (or half) of flange portion 34 includes spaced-apart notches 24 for accommodating wall ties 16, i.e. for allowing wall tie 16 to pass through or around the retaining strip 22.

Figure 6:
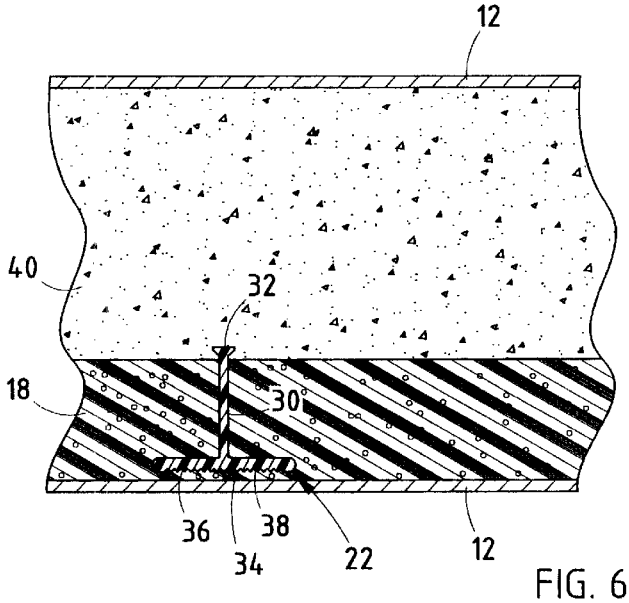
FIG. 6 is a horizontal cross-sectional view of a poured concrete wall in accordance with this invention.

As shown in FIG. 6, which is a vertical cross section of a finished wall after concrete 40 has been poured between wall forms 12 but before the forms 12 have been removed, anchor portion 32 of retaining strip 22 is embedded within the concrete wall 40. The T-shaped profile provides improved rigidity and strength for hanging wall coverings such as drywall, paneling, siding (when the insulation is on the exterior side of the wall), etc. Improved rigidity and strength is also achieved by embedding a portion 32 of the retaining strip 22 in concrete wall 40. The resulting structure shown in FIG. 6, in addition to accommodating wall coverings, can support relatively heavy loads such as large wooden cabinets and the like without warping, buckling, distorting or pulling away from the wall on account of the additional rigidity and strength provided by web 30 and by embedding the anchor portion 32 of retaining strip 22 in concrete wall 40.

In order to facilitate easier insertion of fasteners into flange portion 34 of retaining strip 22, flange portion 34 is provided with a serrated surface as shown in FIG. 5. The serrations help guide a fastener into the flange portion 34 making it easier to initiate penetration of a threaded fastener through flange portion 34.

The wall structure shown in FIG. 6 is constructed by first assembling the wall forms 12 with the connecting pins 14 and wall tie 16 as shown in FIG. 1. Thereafter, a plurality of insulating panels 18 and retaining strips 22 are positioned inside the wall forms 12 and along one of the two parallel wall surfaces. The retaining strips 22 are temporarily held in place by the grooves 20 in insulation panels 18.

Insulating panels 18 can be made of generally any relatively rigid insulating material, such as rigid polyurethane foam or rigid polystyrene foam. Panels 18 can be of generally any width, typically from about 2 feet to about 6 feet, and generally any height, typically from about 2 feet to about 10 feet, and can have any desired thickness, typically from about 2 to about 3 inches.

The retaining strips 22 can be made of any of various suitable materials such as wood, plastic or metal. The web portion 30 and flange portion 34 of retaining strips 22 are relatively thin, typically about ⅛ inch in thickness. The width of the web portion 30 and the flange portion 34 is typically from about 1–½ inches to about 4 inches. Preferably, the retaining strips 22 are made of a material to which conventional fasteners such as screws and nails can be secured.

To create the insulated poured concrete wall, uncured concrete is poured into the cavity formed between the two series of coplanar wall forms 12. The expression "poured" includes any method or manner in which uncured concrete can be deposited into the cavity between wall forms 12, whether by hand, from the concrete truck chute, from a pumping system, etc. Once the concrete has set (typically from about 12 to about 24 hours), the forms 12 are removed by releasing the connecting pins 14 from the holes of the walls ties 16. The forms are then pulled away from the concrete wall. Once the pins and forms are removed, the concrete wall remains with the wall ties 16 embedded within the concrete wall, with insulating panels 18 secured to at least one side of the concrete wall. A portion of wall ties 16 that extends outwardly from the wall surface is typically broken or snapped off.

Although the wall structure shown in the drawings includes insulation panel 16 on only one side of concrete wall 40, the method of this invention can be employed to provide insulation on both sides of concrete wall 40. An insulating surface may be provided on only the exterior side of the poured concrete wall such as to facilitate use of flange 34 of retainer 22 to attach exterior siding to the wall. Insulating panels can be provided only on the interior side of the wall with flange portion 34 of retaining strip 22 used for attaching interior drywall, paneling, or the like. When the wall system and method of this invention is used for insulating both sides of a poured concrete wall, the retaining strips on the exterior side of the wall can be used for securing exterior siding to the wall, and the retaining strips on the interior side of the wall can be used for securing drywall or the like.

Figure 7:
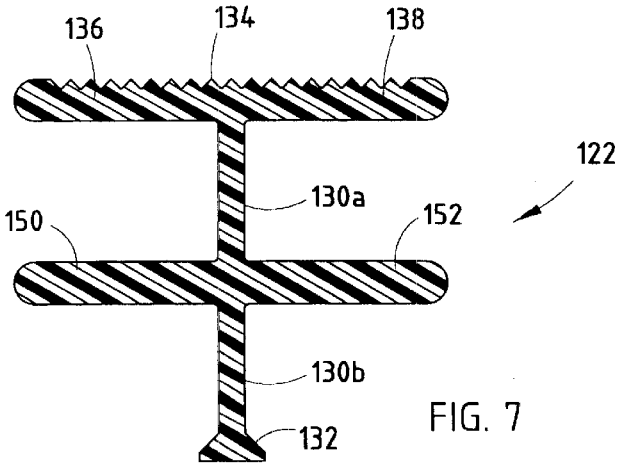
FIG. 7 is a transverse cross-sectional view of an alternative-retaining strip in accordance with this invention.

In FIG. 7, there is shown an alternative embodiment of the retaining strip 122. Retaining strip 122 includes a segmented web portion including a web portion segment 130A extending between an exterior flange 134 and a parallel interior flange 135, and a second web portion segment 130B extending from interior flange 152 to an enlarged anchor portion 132. Depending on the dimensions of retaining strip 122, and the dimensions of insulating panel 18, insulating panel 18 may be retained between flanges 134 and 152, or flanges 134 and 152 may engage parallel grooves in the edges of adjacent panels 18. As another alternative one or the other of flanges 134 and 152 may be engaged in a groove formed in the edge of an insulating panel 18, while the other flange engages one or the other side of panel 18. The parallel flange arrangement of retaining strip 122 allows a fastener such as a screw or nail to penetrate two parallel structures (flanges 134 and 152), whereby improved strength, rigidity and stability are provided for supporting objects, especially heavy objects such as cabinets and the like.

Web 30 may be scalloped (e.g., have a width that varies along the length of web 30) to provide a control joint that limits cracking of concrete wall 40 in a limited area.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A system for forming an insulated poured concrete wall, comprising:

spaced-apart wall forms forming opposing wall surfaces that define a cavity;

a plurality of insulating panels arranged adjacent at least one of the opposing wall surfaces; and a plurality of elongate retaining strips between adjacent insulating panels, each of the elongate retaining strips including a web portion that extends into the cavity and a flange portion that is at a right angle with respect to the web portion.

2. The system of claim 1, wherein the retaining strip has a T-shaped cross-sectional profile, with the flange portion including a first half that extends laterally in a first direction away from the web portion, and a second half that extends laterally in an oppose direction from the web portion.

3. The system of claim 2, wherein the first and second halves of the flange portion are each received in a groove in an edge of an insulating panel.

4. The system of claim 1, wherein the web includes an enlarged anchor portion located in the cavity.

5. The system of claim 1, wherein the flange portion has a serrated surface.

6. The system of claim 1, wherein the retaining strip includes a segmented web portion extending between an exterior flange and an interior flange, and a second web portion segment extending from the interior flange to an enlarged anchor portion that is located in the cavity.

7. A method of forming an insulated concrete wall, comprising:

arranging a plurality of wall forms in spaced relationship to form opposing wall surfaces defining a cavity;

arranging insulating panels adjacent one of the opposing wall surfaces; and arranging a plurality of elongate retaining strips between adjacent insulating panels, wherein each of the elongate retaining strips includes a web portion that projects into the cavity and a flange portion that is at a right angle with respect to the web portion.

8. The method of claim 7, wherein the retaining strip has a T-shaped cross-sectional profile, with the flange portion including a first half that extends laterally in a first direction away from the web portion, and a second half that extends laterally in an oppose direction from the web portion.

9. The method of claim 8, wherein the first and second halves of the flange portion are each received in a groove in an edge of an insulating panel.

10. The method of claim 7, wherein the web includes an enlarged anchor portion located in the cavity.

11. The method of claim 7, wherein the flange portion has a serrated surface.

12. The method of claim 7, wherein the retaining strip includes a segmented web portion extending between an exterior flange and an interior flange, and a second web portion segment extending from the interior flange to an enlarged anchor portion that is located in the cavity.

13. An insulated poured concrete wall comprising:

a concrete wall having opposing wall surfaces;

a plurality of insulating panels arranged adjacent at least one of the opposing wall surfaces; and a plurality of spaced-apart, elongate retaining strips engaging the insulation panels, the elongate retaining strips having a web portion embedded in the concrete wall and a flange portion that is at a right angle with respect to the web portion.

14. The wall of claim 13, wherein the retaining strip has a T-shaped cross-sectional profile, with the flange portion including a first half that extends laterally in a first direction away from the web portion, and a second half that extends laterally in an oppose direction from the web portion.

15. The wall of claim 14, wherein the first and second halves of the flange portion are each received in a groove in an edge of an insulating panel.

16. The wall of claim 13, wherein the web includes an enlarged anchor portion located in the cavity.

17. The wall of claim 13, wherein the flange portion has a serrated surface.

18. The wall of claim 13, wherein the retaining strip includes a segmented web portion extending between an exterior flange and an interior flange, and a second web portion segment extending from the interior flange to an enlarged anchor portion that is located in the cavity.

19. A system for forming an insulated poured concrete wall, comprising: spaced-apart wall forms forming opposing wall surfaces that define a cavity;

a plurality of vertically and horizontally spaced-apart wall ties extending between the opposing wall forms;

a plurality of insulating panels arranged adjacent at least one of the opposing wall surfaces, each of the insulating panels having opposite vertical edges and a groove recessed into each of the vertical edges; and an elongate retaining strip between each of the adjacent insulating panels, each elongated retaining strip having a flange portion extending into the grooves of adjacent vertical edges of the insulating panel and at least one notch through which a wall tie passes.

20. The system of claim 19, wherein the retaining strip includes a web portion and a flange portion that is at a right angle with respect to the web portion.

21. The system of claim 20, wherein the retaining strip has a T-shaped cross-sectional profile, with the flange portion including a first half that extends laterally in a first direction away from the web portion, and a second half that extends laterally in an oppose direction from the web portion.

22. The system of claim 21, wherein the first and second halves of the flange portion are each received in a groove in an edge of an insulating panel.

23. The system of claim 20, wherein the web includes an enlarged anchor portion located in the cavity.

24. The system of claim 20, wherein the flange portion has a serrated surface.

25. The system of claim 19, wherein the retaining strip includes a segmented web portion extending between an exterior flange and an interior flange, and a second web portion segment extending from the interior flange to an enlarged anchor portion that is located in the cavity.

26. A method of forming an insulated concrete wall, comprising:

arranging a plurality of wall forms in spaced relationship to form opposing wall surfaces defining a cavity;

arranging in vertically and horizontally spaced-apart relationship wall ties extending between the opposing wall forms;

arranging insulating panels adjacent at least one of the opposing wall surfaces, each of the insulating panels having opposite vertical edges and a groove recessed into each of the vertical edges; and arranging elongate retaining strips between adjacent insulating panels, each of the elongate retaining strips having a flange portion extending into the grooves of adjacent vertical edges of the insulating panels and at least one notch through which a wall tie passes.

27. The method of claim 26, wherein the retaining strip includes a web portion and a flange portion that is at a right angle with respect to the web portion.

28. The method of claim 27, wherein the retaining strip has a T-shaped cross-sectional profile, with the flange portion including a first half that extends laterally in a first direction away from the web portion, and a second half that extends laterally in an oppose direction from the web portion.

29. The method of claim 28, wherein the first and second halves of the flange portion are each received in a groove in an edge of an insulating panel.

30. The method of claim 27, wherein the web includes an enlarged anchor portion located in the cavity.

31. The method of claim 27, wherein the flange portion has a serrated surface.

32. The method of claim 26, wherein the retaining strip includes a segmented web portion extending between an exterior flange and an interior flange, and a second web portion segment extending from the interior flange to an enlarged anchor portion that is located in the cavity.

33. An insulated poured concrete wall, comprising:

a concrete wall having opposing wall surfaces;

a plurality of vertically and horizontally spaced wall ties contained within the concrete wall and extending between the opposing wall surfaces;

a plurality of intersecting panels arranged adjacent at least one of the opposing wall surfaces, each of the insulating panels having opposite vertical edges and a groove recessed into each of the vertical edges; and a plurality of elongate retaining strips between each of the adjacent insulating panels, each elongate retaining strip having a flange portion extending into the grooves of adjacent vertical edges of the insulating panels and at least one notch through which a wall tie passes.

34. The wall of claim 33, wherein the retaining strip includes a web portion and a flange portion that is at a right angle with respect to the web portion.

35. The wall of claim 34, wherein the retaining strip has a T-shaped cross-sectional profile, with the flange portion including a first half that extends laterally in a first direction away from the web portion, and a second half that extends laterally in an oppose direction from the web portion.

36. The wall of claim 35, wherein the first and second halves of the flange portion are each received in a groove in an edge of an insulating panel.

37. The wall of claim 34, wherein the web includes an enlarged anchor portion located in the cavity.

38. The wall of claim 34, wherein the flange portion has a serrated surface.,

39. The wall of claim 33, wherein the retaining strip includes a segmented web portion extending between an exterior flange and an interior flange, and a second web portion segment extending from the interior flange to an enlarged anchor portion that is located in the cavity.

* * * * *

UNITED STATES PATENT AND TRADEMARK OFFICE

CERTIFICATE OF CORRECTION

PATENT NO. : 6,634,148 B2
DATED : October 21, 2003
INVENTOR(S) : Edward C. Shidler It is certified that error appears in the above-identified patent and that said Letters Patent is hereby corrected as shown below:

Column 3,
Line 35, after “cross-sectional” insert -- view --.
Line 59, “ones” should be -- one --.

Column 5,
Line 37, “panel 16” should be -- panel 18 --.

Column 6,
Lines 32 and 60, “oppose” should be -- opposite --.

Column 7,
Lines 19 and 53, “oppose” should be -- opposite --.

Column 8,
Lines 20 and 55, “oppose” should be -- opposite --.

Signed and Sealed this

Fourth Day of May, 2004

JON W. DUDAS
*Acting Director of the United States Patent and Trademark Office*